US005154272A

United States Patent [19]

Nishiumi et al.

[11] Patent Number: 5,154,272

[45] Date of Patent: Oct. 13, 1992

[54] CONTROLLER FOR AN AUTOMATIC VENDING MACHINE

[75] Inventors: Kenji Nishiumi, Sakado; Shusuke Sumi, Tsurugashima; Kenji Nakajima, Ogose, all of Japan

[73] Assignee: Kabushiki Kaisha Nippon Conlux, Tokyo, Japan

[21] Appl. No.: 685,786

[22] Filed: Apr. 16, 1991

[30] Foreign Application Priority Data

Apr. 18, 1990 [JP] Japan ..... 2-102688

[51] Int. Cl.[5] ..... G07D 5/08

[52] U.S. Cl. ..... 194/318; 194/217

[58] Field of Search ..... 194/216, 217, 218, 317, 194/318, 319

[56] References Cited

U.S. PATENT DOCUMENTS

| | | | |
|---|---|---|---|
| 3,918,564 | 11/1975 | Heiman et al. | 194/318 |
| 4,184,366 | 1/1980 | Butler | 194/317 |
| 4,267,915 | 5/1981 | McLaughlin | 194/219 |
| 4,462,513 | 7/1984 | Dean et al. | 194/318 |
| 4,538,719 | 9/1985 | Gray et al. | 194/317 |
| 4,556,140 | 12/1985 | Okada | 194/334 X |
| 4,572,349 | 2/1986 | Furuya et al. | 194/318 |
| 4,749,074 | 6/1988 | Ueki et al. | 194/317 |
| 5,067,604 | 11/1991 | Metcalf | 194/317 X |

FOREIGN PATENT DOCUMENTS

| | | | |
|---|---|---|---|
| 0024150 | 2/1981 | European Pat. Off. | 194/217 |
| 58-54772 | 4/1983 | Japan . | |
| 2-48788 | 2/1990 | Japan . | |
| 2-50288 | 2/1990 | Japan . | |
| 2-11951 | 3/1990 | Japan . | |
| 3-07996 | 2/1991 | Japan . | |
| 2128006 | 4/1984 | United Kingdom . | |
| 2199978 | 7/1988 | United Kingdom | 194/317 |

*Primary Examiner*—F. J. Bartuska
*Attorney, Agent, or Firm*—Diller, Ramik & Wight

[57] ABSTRACT

A controller for an automatic vending machine in which the specification for each of a plurality of countries is set easily. If a country setting switch sets a specification for a desired country, parameter values corresponding to the specification are read from a memory and elements required for changing the specification are controlled in accordance with the parameter values. The parameter values include, for example, respective threshold levels for the inserted coins for each of the countries and the values indicative of the distributing manners to distribute the respective inserted coins for each of the countries.

3 Claims, 8 Drawing Sheets

CONTROLLER FOR AN AUTOMATIC VENDING MACHINE

BACKGROUND OF THE INVENTION

1. Field of the Invention

The present invention relates to a controller for an automatic vending machine and more particularly to a controller for an automatic vending machine, the specification of which is easily changed to meet the conditions of various countries.

2. Description of the Related Art

Automatic vending machines have been widely used in various countries. In designing an automatic vending machine for use in a plurality of countries, specifications are required to vary from country to country because the currencies and denominations are different in each country.

For example, the material and shape of coins vary in each country, so that the threshold levels for selecting the coins in an automatic vending machine vary. In addition, the number of kinds of coins to be inserted in the automatic vending machine varies from country to country. Therefore, the manner to distribute the inserted coins to the appropriate coin tubes in the vending machine differs from country to country.

Conventionally, automatic vending machines have been designed and manufactured with a fixed specification for each country. However, with such machines, if there are a large number of countries where the vending machines are to be used, design and manufacturing of the vending machines must be changed for each country, thus manufacturing efficiency is low.

In addition, if the design of the current coins is changed, the conventional vending machines cannot easily adjust to the change.

SUMMARY OF THE INVENTION

It is an object of the present invention to provide a controller for an automatic vending machine which can be designed and manufactured efficiently, and can be easily adjusted to a change of the design of the current coins.

In order to achieve the above object, the present invention provides a controller for an automatic vending machine comprising a country setting switch for setting the operation of the machine on the basis of a specification for each of countries; means for storing a parameter value corresponding to the specification for that country; and control means for reading from the storing means a parameter value corresponding to the specification selected by the country setting switch in correspondence to the selective operation of the country selecting switch and controlling the appropriate elements of the machine in accordance with that parameter value.

When a specification of a country is set by the country setting switch, a parameter value corresponding to the set specification is read from the storing means and some elements of the machine are controlled in accordance with the read parameter for a change in the specification. The country setting switch may comprise a dip switch, for example.

The storing means may store a threshold level for an inserted coin used in each of the countries as the parameter values. The control means may read from the storing means a threshold level corresponding to the specification selected by the country selecting switch and judges the inserted coin in accordance with the read threshold level.

The storing means may store as the parameter value the manner in which an inserted coin for use in each of the countries is distributed. The control means may read from the storing means the manner in which the inserted coin is distributed in correspondence to the manner selected by the country setting switch and may control the distribution of the coin in accordance with the read distributing manner.

According to the present invention, with the country setting switch capable of setting various specfications to meet conditions of each country, the efficiency of designing and manufacturing of the vending machines are improved and the adjusting to the change in the current coins is easily made.

DESCRIPTION OF THE PREFERRED EMBODIMENTS

One embodiment of the present invention will be described in more detail with reference to the accompany drawings.

Figure 1:
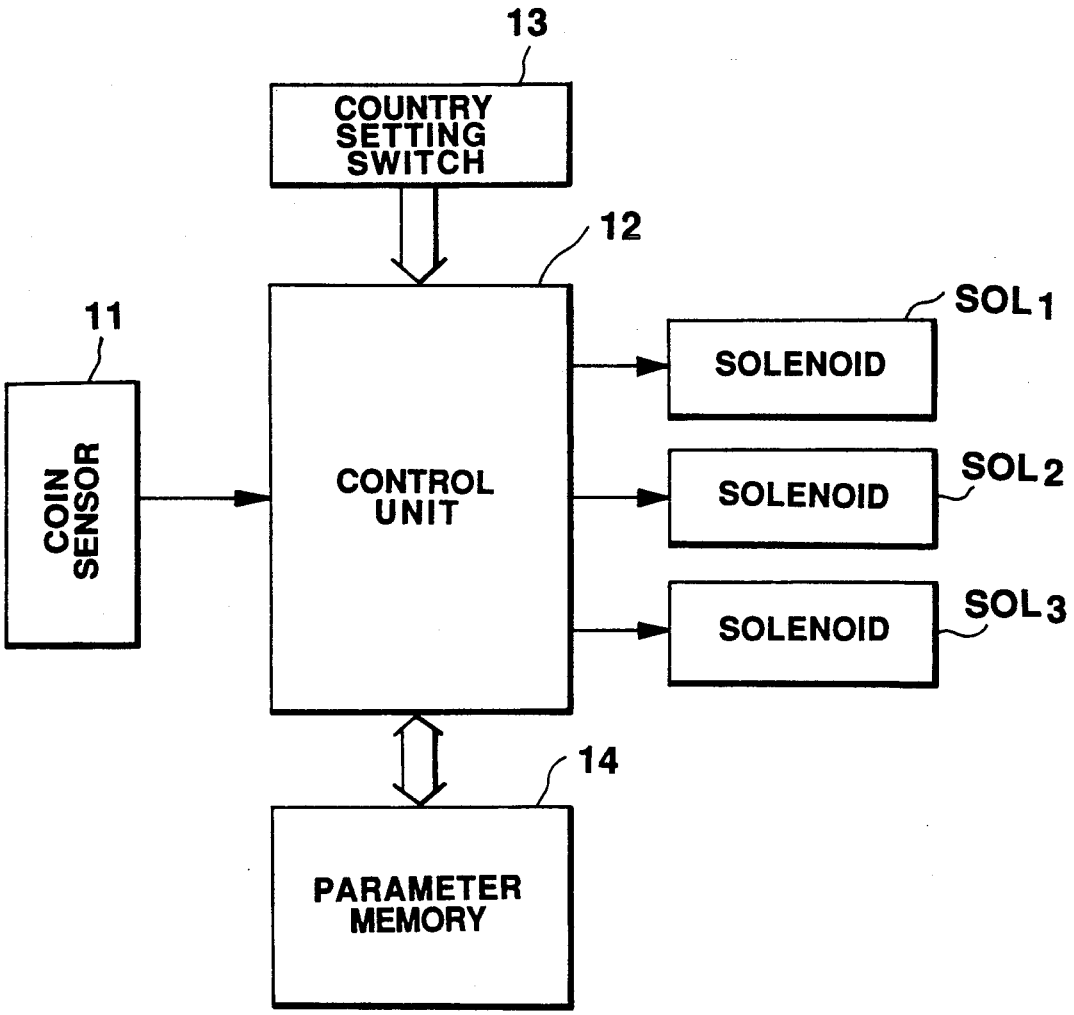
FIG. 1 is a block diagram of a controller for an automatic vending machine according to the present invention.
Figure 2:
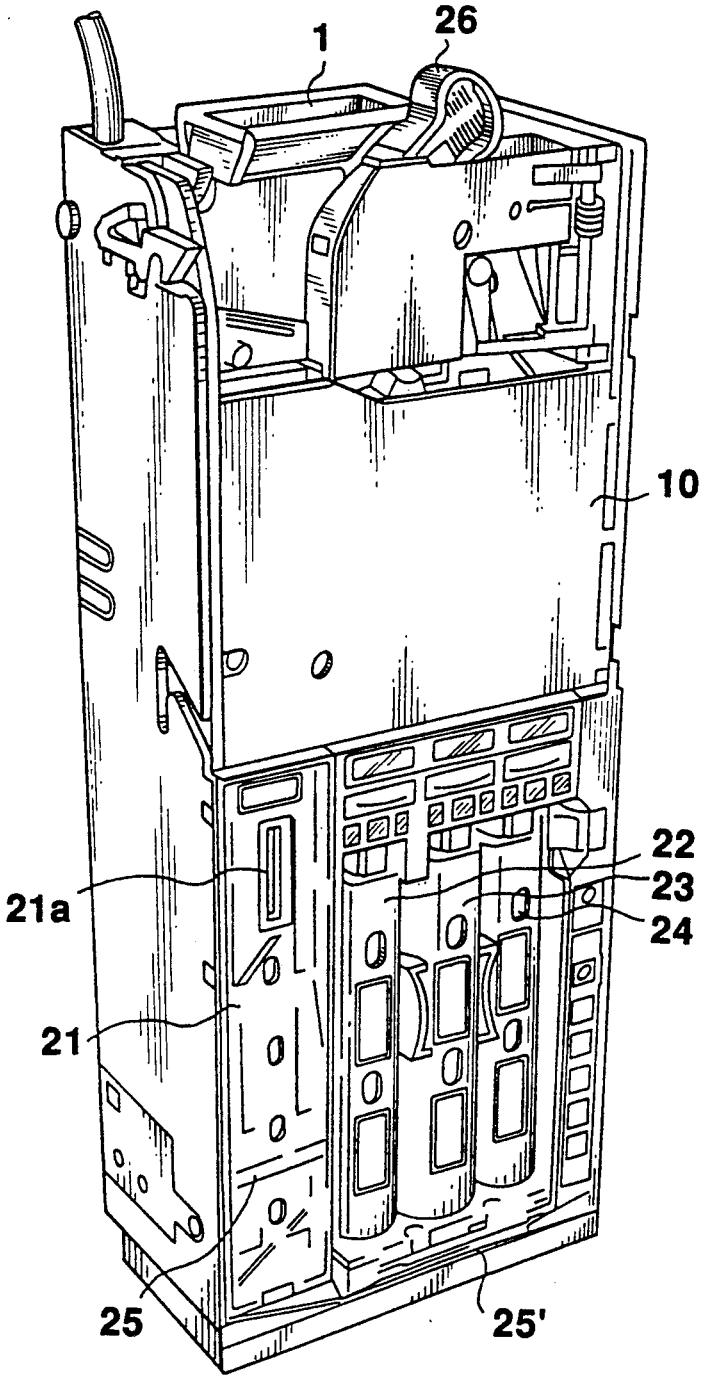
FIG. 2 is a perspective view of a coin changer to which the present invention is applied.

FIG. 1 is a block diagram of an embodiment of a controller for an automatic vending machine according to the present invention. FIG. 2 shows the appearance of a coin changer to which is applied the embodiment of FIG. 1.

In FIG. 2, the coin changer includes first coin tube 21 which is automatically and manually fed with coins inserted through coin inlet 1, and second, third and fourth coin tubes 22, 23 and 24 which are automatically fed with coins inserted through coin inlet 1. Acceptor 10 judges the validation and kind of the coin inserted through coin inlet 1 and selectively distributes the coin to one of first-fourth coin tubes 21–24 and a cash box (not shown) and returns the coin to a coin return outlet (not shown) if it is a false one. Manual coin feed port 21*a* is used to manually supplement coins; coin payment unit 25 gives change from among the coins stored in first coin tube 21; coin payment unit 25' is used to give change and return coins from among the coins stored in second-fourth coin tubes 22–24; and lever 26 is used to discharge the coins jamming in a coin passageway in acceptor 10.

Figure 3:
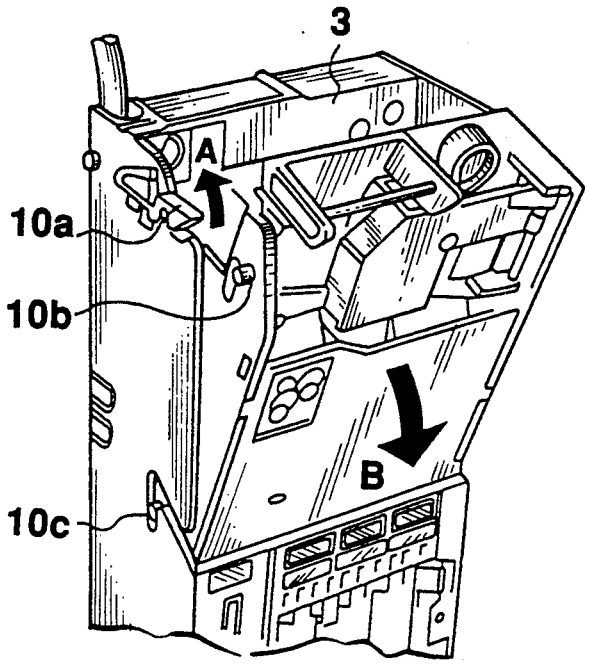
FIG. 3 is a perspective view of an acceptor drawn out of the coin changer of FIG. 2.
Figure 4:
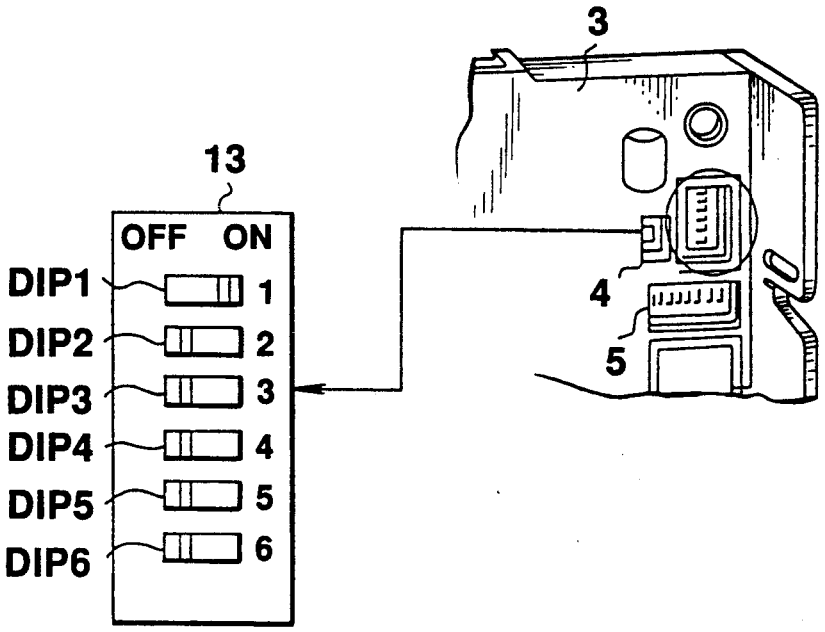
FIG. 4 illustrates the provision of a country setting switch.

In acceptor 10 shown in FIG. 3, turning hook 10*a* in the direction of arrow A disengages hook 10*a* from protrusion 10*b*, and rotation of acceptor 10 around pin 10*c* in the direction of arrow B disengages acceptor 10 from the coin changer proper. As shown in FIG. 4, the front 3 of the acceptor accommodating unit of the coin changer has forced acceptance switch 4, price setting switch 5 and country setting switch 13 according to the present invention. In FIG. 4, forced acceptance switch 4 is used to set a mode in which the inserted coin is forcedly accepted by the cash box, and price setting switch 5 is used to set the selling price of commodities to be sold by the machine.

If forced acceptance switch 4, which is not directly related to the present invention, is switched on, the coins introduced into the cash box (those coins have relatively high denominations) are forcedly accepted by the cash box irrespective of whether change is prepared or not and change is given within the range of sum of coins stored in first-fourth coin tubes 21–24. In this case, it is not ensured that the total sum of change is given, but commodities are sellable even if change lacks. Forced acceptance switch 4 is provided to satisfy the demand of the users who want to buy commodities even if they cannot get full change. If the forced acceptance switch 4 is switched on, a mode is set in which selling commodities has priority over others.

As shown in FIG. 4, country setting switch 13 includes six dip switches DIP 1–DIP 6. By a selective operation of these switches, the specification for each country is set. For example, if only dip switch DIP 1 is switched on, first specification S-1 is set, and if only dip switch DIP 2 is switched on, second specification S-2 is set. The relation between the combination of operated dip switches DIP 1–DIP 6 and the corresponding set specifications is shown in Table 1 below:

TABLE 1

| Dip switch No. | | | | | | |
|---|---|---|---|---|---|---|
| 1 | 2 | 3 | 4 | 5 | 6 | Specification |
| 1 | 0 | 0 | 0 | 0 | 0 | S - 1 |
| 0 | 1 | 0 | 0 | 0 | 0 | S - 2 |
| 0 | 0 | 1 | 0 | 0 | 0 | S - 3 |
| 0 | 0 | 0 | 1 | -0 | 0 | S - 4 |
| 0 | 0 | 0 | 0 | 1 | 0 | S - 5 |
| 0 | 0 | 0 | 0 | 0 | 1 | S - 6 |

1 . . . Energized: 0 . . . Deenergized

Figure 5:
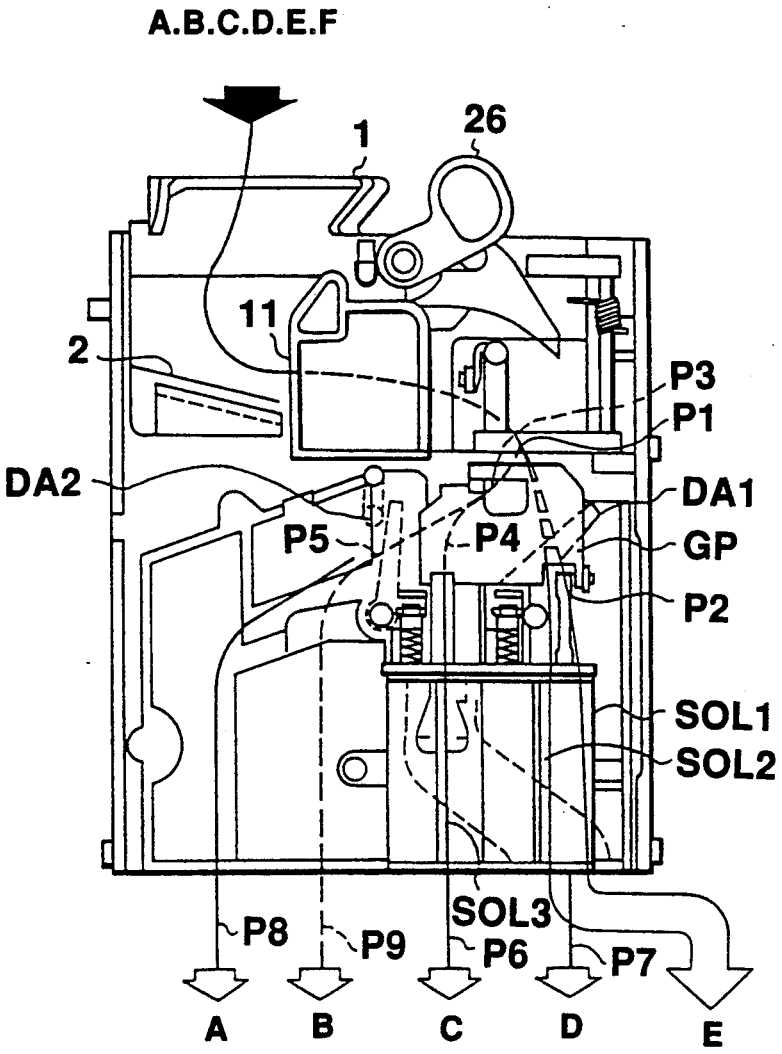
FIG. 5 illustrates the details of the acceptor.

The details of acceptor 10 are shown in FIG. 5. In FIG. 5, acceptor 10 includes coin sensor 11 which judges a coin which is inserted through coin inlet 1 and rolls along guide rail 2, and three solenoids SOL 1, SOL 2 and SOL 3 which are driven such that the genuine coins judged by coin sensor 11 are distributed to first-fourth coin tubes 21–24 and the cash box (not shown) for storing purposes and false coins are returned to the coin outlet (not shown).

Coin sensor 11 may be a well-known electronic coin sensor which judges the validation and kind of the inserted coin on the basis of the electromagnetic characteristic of the coin.

Acceptor 10 can discriminate five kinds of genuine coins one from the other and discriminates genuine coins from false ones. Assume now that the five kinds of genuine coins used in the controller of the present embodiment are coins A, B, C, D and that E the false coin is coin F.

Solenoid SOL 1 discriminates between genuine coins A, B, C, D and E and false coin F. If the coin judged by coin sensor 11 is a genuine one, solenoid SOL 1 is energized to thereby turn guide plate GP to open a passage for the genuine coin and guides the genuine coin which has passed through coin sensor 11 through coin passage P1 behind guide plate GP to the genuine coin passage. If the coin judged by coin sensor 11 is a false one, solenoid SOL 1 is deenergized and guide plate GP closes the genuine coin passage and guides the false coin which has passed through coin sensor 11 to the coin outlet (not shown) through a passage before guide plate GP.

Solenoid SOL 2 discriminates coins A, B, C and D of the coins discriminated by solenoid SOL 1 and guided to first, second, third and fourth coin tubes 21, 22, 23 and 24 from coin E guided to the cash box. Namely, if the genuine coins judged by coin sensor 11 are coins A, B, C and D, solenoid SOL 2 is deenergized and discriminating arm DA 1 closes coin passage P2 to the cash box, as shown, and guides coins A, B, C, D to coin passage P3. However, if the coin judged by the sensor 1 is genuine coin E, solenoid SOL 2 is energized to thereby turn discriminating arm DA 1 counterclockwise to open coin passage P2 to the cash box and close coin passage P3. Thus, coin E is guided to the cash box.

Solenoid SOL 3 discriminates coins A, B between coins C, D. If the coin judged by coin sensor 11 is coin C or D, solenoid SOL 3 is deenergized, so that discriminating arm DA 2 closes coin passage P5, as shown, and guides coins C, D to coin passage P4. However, if the coin judged by coin sensor 11 is coin A or B, solenoid SOL 3 is energized to thereby turn discriminating arm DA 2 clockwise to open coin passage P5 and close coin passage P4. Thus, coin A or B is guided to coin passage P5.

Coins C, D guided to coin passage P4 are discriminated according to diameter. Coin C is guided to coin passage P6 which leads to third coin tube 23 while coin D is guided to coin passage P7 which leads to fourth coin tube 24.

Coins A, B guided to coin passage P5 are discriminated according to diameter. Coin A is guided to coin passage P8 which leads to first coin tube 21 while coin B is guided to coin passage P9 which leads to second coin tube 22.

The manner in which the coins are discriminated are shown in Table 2, in conjunction with the relationship between the kinds of coins and the operations of solenoids SOL 1, SOL 2 and SOL 3 as follows:

TABLE 2

| Kinds of Coins | SOL 1 | SOL 2 | SOL 3 |
|---|---|---|---|
| A | 1 | 0 | 1 |
| B | 1 | 0 | 1 |
| C | 1 | 0 | 0 |
| D | 1 | 0 | 0 |
| E | 1 | 1 | 0 |
| F | 0 | 0 | 0 |

1 . . . Energized: 0 . . . Deenergized

Figure 6:
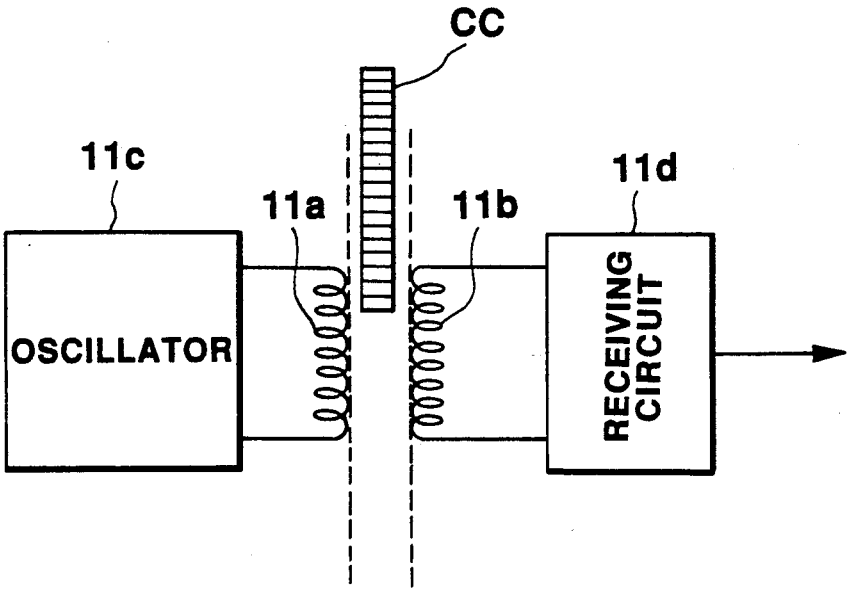
FIG. 6 illustrates the details of a coin sensor.

In FIG. 1, coin sensor 11 which judges the validation and kind of an inserted coin is disposed along guide rail 2 which guides the coin inserted through coin inlet 1, as shown in FIG. 5. For example, as shown in FIG. 6, coin sensor 11 includes oscillating coil 11*a* disposed along the coin passage, receiving coil 11*b*, oscillator 11*c* which energizes oscillating coil 11*a* with a signal with a predetermined frequency, and receiving circuit 11*d* which receives a signal induced in receiving coil 11*b* in accordance with the passage of coin C. Control unit 12 determines the coin by receiving the output signal from receiving circuit 11*d*.

Figure 7:
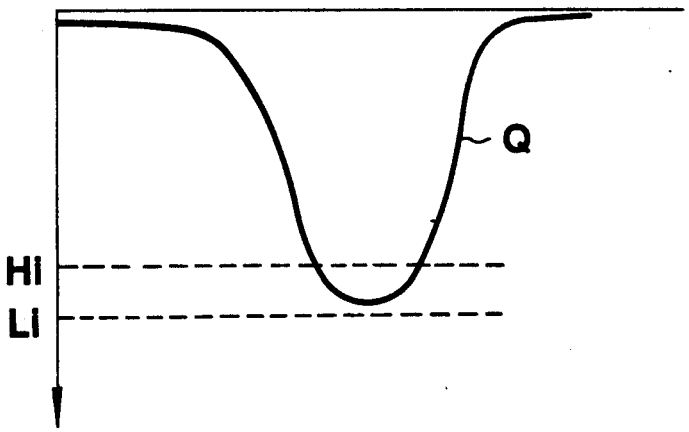
FIG. 7 illustrates the principles of detecting a coin by the coin sensor of FIG. 6.

Control unit 12 has a plurality of window circuits and determines that the coin is a genuine one corresponding to a window in one of the window circuits if the peak value of the output signal from receiving circuit 11*d* enters that window. This operation will be described in more detail with reference to FIG. 7. Waveform signal Q in FIG. 7 shows an illustrative signal waveform output from receiving circuit 11*d* of FIG. 6. Level values Hi and Li constitute a window of a window circuit of control unit 12. If the peak value of waveform signal Q output from receiving circuit 11*d* falls between levels Hi and Li, control unit 12 determines that the coin is a genuine one corresponding to level values Hi and Li. A pair of level values Hi and Li is set for each of the coins used and inherent to that coin. Therefore, there are set pairs of level values Hi and Li equal in number to the kinds of coins used.

The present embodiment is arranged so as to select any one of a plurality of different specifications by setting country setting switch 13. Pairs of level values Hi and Li one for each of the specifications are set as parameter values in parameter memory 14. Control unit 12 reads from parameter memory 14 a necessary parameter comprising a pair of levels Hi and Li in correspondence to the setting of country setting switch 13 and judges the inserted coin in correspondence to an appropriate one of the specifications in accordance with the read parameter value.

Setting which of the coin tubes and cash box the judged coin should be distributed and guided to differs from specification to specification. In the present embodiment, a destination for storage of each coin used is set as a parameter value for that coin in parameter memory 14. Control unit 12 reads a parameter value indicative of the destination for storage of the coin from parameter memory 14 in correspondence to the setting of country setting switch 13 and distributes the coin judged in accordance with the read parameter. This distribution is performed by selectively driving first, second and third solenoids SOL 1, SOL 2 and SOL 3, as mentioned above.

Table 3 below shows an example of parameter values stored in parameter memory 14 for specification S-1. Similar parameter values are set also for other specifications S-2 to S-6.

TABLE 3

| Coin Used | Hi | Li | Destination |
|---|---|---|---|
| P 1 | H 11 | L 11 | A |
| P 2 | H 12 | L 12 | B |
| P 3 | H 13 | L 13 | C |
| P 4 | H 14 | L 14 | D |
| P 5 | H 15 | L 15 | E |

In Table 3, destinations for distribution A–E correspond to those for coins A–E in FIG. 5. For example, coin P1 is judged according to the window of levels H 11 and L 11 and has a destination A determined by a combination of on-solenoid SOL 1, off-solenoid SOL 2 and on-solenoid SOL 3. It is then distributed to first coin tube 21 due to its diameter.

Figure 8:
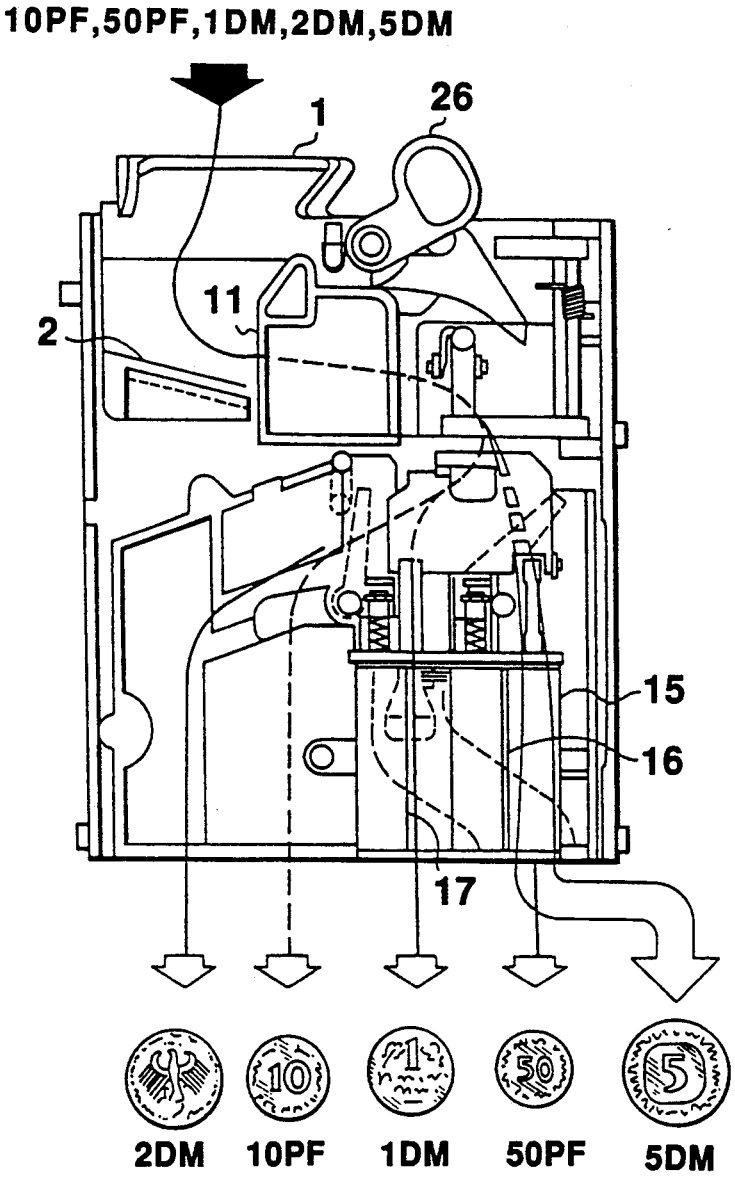
FIGS. 8–10 illustrates a specified example of coin distribution.
Figure 9:
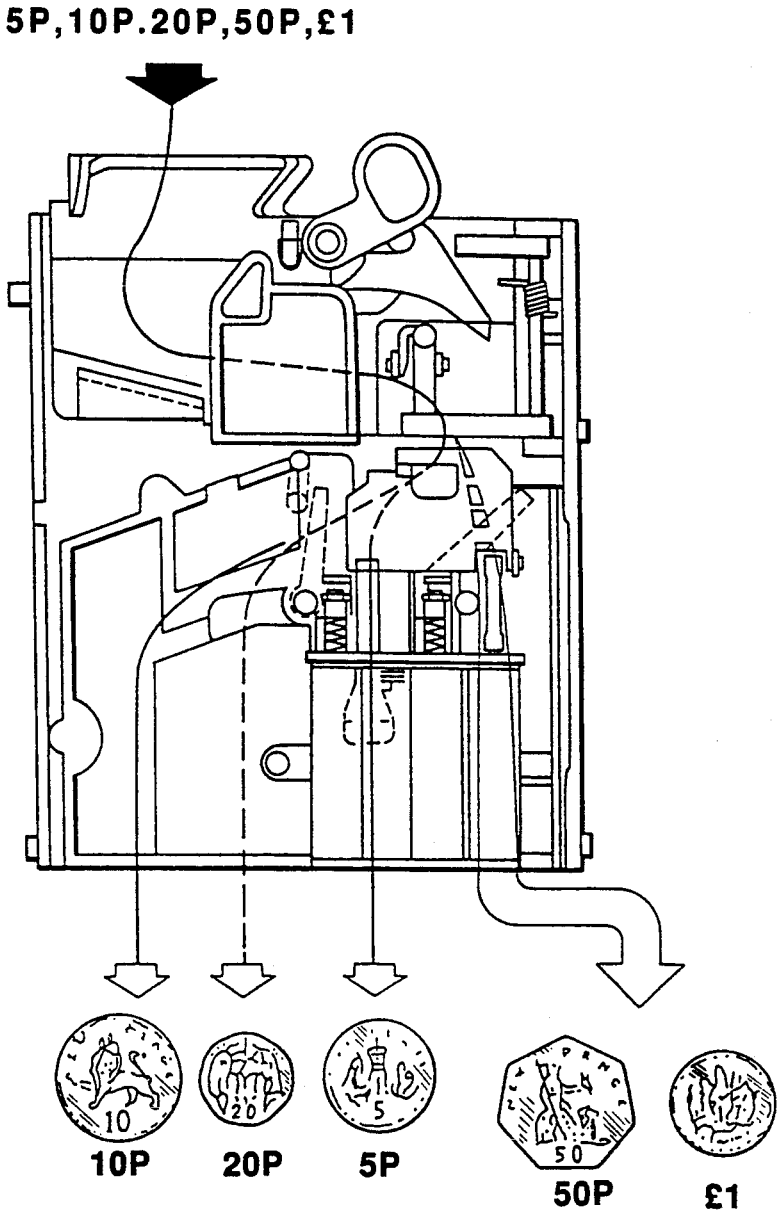
Figure 10:
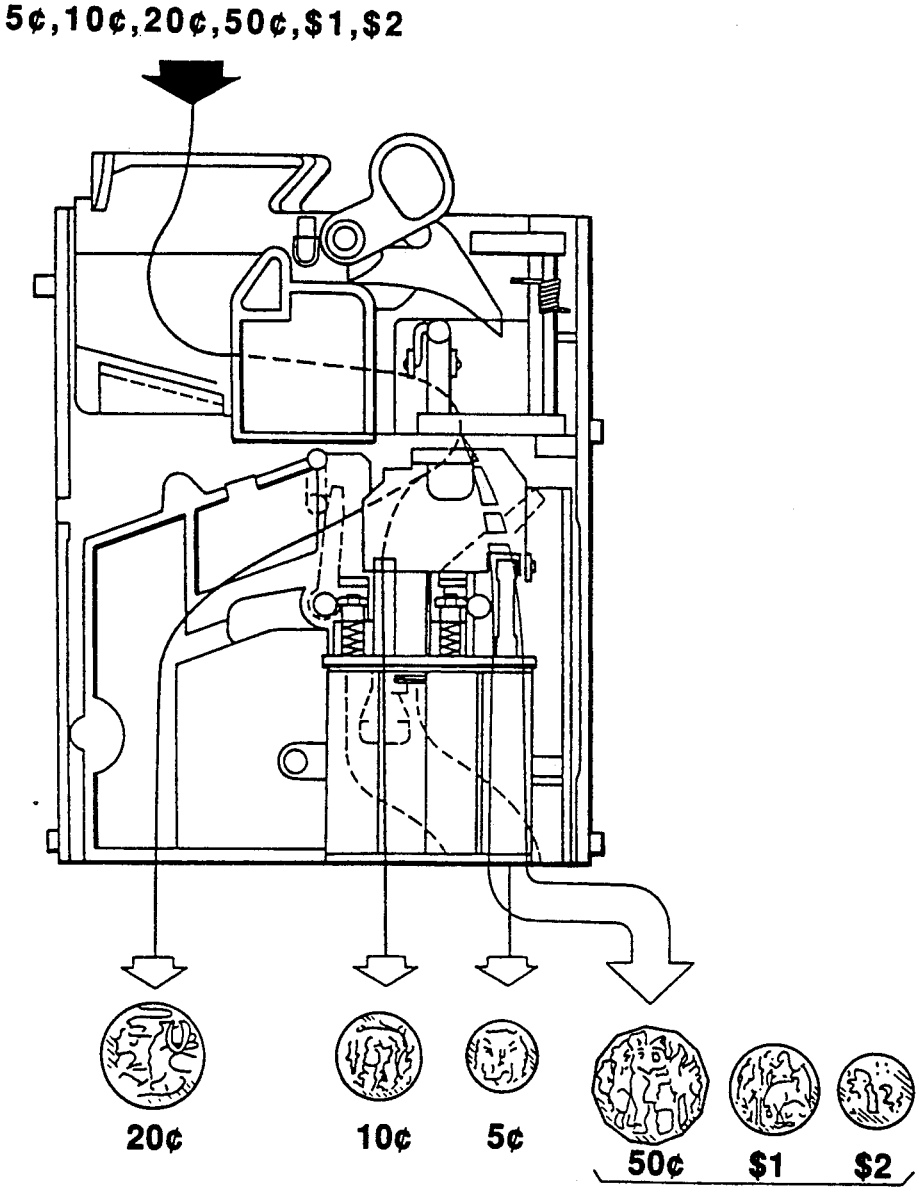

Referring to FIGS. 8–10, a specified example will be described. FIG. 8 shows the manner in which coins are distributed in the Germany specification. In this specification, the coins used are five in kind; 10PF (pfennigs), 50PF, 1DM (Deutche Mark), 2DM and 5DM. In this case, if the inserted coins are 2DM, 10pf, solenoid SOL 1 is energized, solenoid SOL 2 is deenergized and solenoid SOL 3 is energized. Thereafter, 2DM is distributed to first coin tube 21 and 10 PF to second coin tube 22 according to diameter. If the inserted coins are 1DM, 50PF, solenoid SOL 1 is energized, solenoid SOL 2 is deenergized and solenoid SOL 3 is deenergized. Thereafter, 1DM is distributed to third coin tube 23 and 50PF to fourth coin tube 24 according to diameter. If the inserted coin is 5DM, solenoid SOL 1 is energized, solenoid SOL 2 is deenergized and solenoid SOL 3 is deenergized and 5DM is distributed to the cash box. If the inserted coin is a false one, all the solenoids SOL 1, SOL 2 and SOL 3 are deenergized and the coin is returned to the coin outlet (not shown). The relationship between coins and combinations of operative and inoperative solenoids is shown in Table 4.

TABLE 4

| Coin | SOL 1 | SOL 2 | SOL 3 |
|---|---|---|---|
| 2DM, 10PF | 1 | 0 | 1 |
| 1DM, 50PF | 1 | 0 | 0 |
| 5DM | 1 | 1 | 0 |

1 . . . Energized: 0 . . . Deenergized

Therefore, stored in parameter memory 14 of FIG. 1 are parameter values indicative of pairs of threshold levels Hi, Li corresponding to 10PF, 50PF, 1DM, 2DM, and 5DM for the German specification and parameter values indicative of the manners of distribution corresponding to the relationships of Table 4.

FIG. 9 shows the manner in which coins are distributed in the British specification. In this specification, the coins used are five in kind; 5P (pence) 10P, 20P, 50P and £ 1 (pound). In this case, if the inserted coins are 10P, 20P, solenoid SOL 1 is energized, solenoid SOL 2 is deenergized and solenoid SOL 3 is energized. 10P is then distributed to first coin tube 21 and 20P to second coin tube 22 according to diameter. If the inserted coin is 5P, solenoid SOL 1 is energized, solenoid SOL 2 is energized and solenoid SOL 3 is deenergized. Thereafter, 5P is distributed to third coin tube 23. If the inserted coins are 50P, £ 1, solenoid SOL 1 is energized, solenoid SOL 2 is deenergized and solenoid SOL 3 is deenergized, and 50P and £ 1 are distributed to the cash box. This relationship is shown in Table 5 below.

TABLE 5

| Coin | SOL 1 | SOL 2 | SOL 3 |
|---|---|---|---|
| 10P, 20P | 1 | 0 | 1 |
| 5P | 1 | 0 | 0 |
| 50P, £1 | 1 | 1 | 0 |

1 . . . Energized: 0 . . . Deenergized

Therefore, stored in parameter memory 14 of FIG. 1 are parameter values indicative of pairs of threshold levels Hi, Li corresponding to 5P, 10P, 20P, 50P and £ 1 for the British specification and parameter values indicative of the manners of distribution corresponding to the relationships of Table 5.

FIG. 10 shows the manner in which coins are distributed in the Australian specification. In this specification, the coins used are six in kind; 5¢ (cents), 10¢, 20¢, 50¢, $1 (dollar) and $2. In this case, if the inserted coin is 20¢, solenoid SOL 1 is energized, solenoid SOL 2 is deenergized and solenoid SOL 3 is energized. 20¢ is then distributed to first coin tube 21. If the inserted coins are 10¢, 5¢, solenoid SOL 1 is energized, solenoid SOL 2 is deenergized and solenoid SOL 3 is deenergized. Thereafter, 10¢ is distributed to third coin tube 23 and 5¢ to fourth coin tube 24 according to diameter. If the inserted coins are 50¢, $1, $2, solenoid SOL 1 is energized, solenoid SOL 2 is deenergized and solenoid SOL 3 is deenergized, and 50¢, $1 and $2 are then distributed to the cash box. This relationship is shown in Table 6 below.

TABLE 6

| Coin | SOL 1 | SOL 2 | SOL 3 |
|---|---|---|---|
| 10¢ | 1 | 0 | 1 |
| 10¢, 5¢ | 1 | 0 | 0 |
| 50¢, $1, $2 | 1 | 1 | 0 |

1 . . . Energized: 0 . . . Deenergized

Therefore, stored in parameter memory 14 of FIG. 1 are parameter values indicative of pairs of threshold levels Hi, Li corresponding to 5¢, 10¢, 20¢, 50¢, $1 and $2 for the Australian specification and parameter values indicative of the manners of distribution corresponding to the relationships of Table 6.

While in the above embodiment the examples in which the parameters indicative of the threshold levels for the coin determination and the parameters indicative of the manners of coin distribution are stored in the parameter memory have been described and shown, the parameter values stored in the parameter memory are not limited to them, but may include parameters indicative of other operations for the corresponding specifications.

What is claimed is:

1. A controller for an automatic vending machine comprising:

a country setting switch for setting the operation of the machine on the basis of a specification for each of countries;

means for storing parameters corresponding to the specification for each country;

control means for reading from the storing means a parameter value corresponding to the specification selected by the country setting switch in correspondence to the selective operation of the country selecting switch and controlling the appropriate elements of the machine in accordance with the parameters, the storing means stores as the parameter value a distributing manner to distribute an inserted coin for each of the countries; and the control means reads from the storing means the distributing manner in correspondence to the specification selected by the country setting switch and controls the distribution of the coin in accordance with the distributing manner.

2. A controller according to claim 1, wherein the country setting switch comprises at least one dip switch.

3. A controller according to claim 1, wherein the storing means stores a threshold level for an inserted coin used in each of the countries as the parameter value; and the control means reads from the storing means a threshold level corresponding to the specification selected by the country selecting switch and judges the inserted coin in accordance with the read threshold level.

* * * * *